US006450500B1

(12) United States Patent
Miller

(10) Patent No.: US 6,450,500 B1
(45) Date of Patent: Sep. 17, 2002

(54) METHOD OF MAKING A SIDE BET DURING A BLACKJACK GAME

(75) Inventor: Alan S. Miller, Sharon, MA (US)

(73) Assignee: Extra Chance Blackjack, LLC, Beverly, MA (US)

( * ) Notice: Subject to any disclaimer, the term of this patent is extended or adjusted under 35 U.S.C. 154(b) by 0 days.

(21) Appl. No.: 09/537,150

(22) Filed: Mar. 29, 2000

(51) Int. Cl.[7] ..... A63F 1/00; A63F 9/20
(52) U.S. Cl. ..... 273/292; 273/304
(58) Field of Search ..... 273/292, 274, 273/309; 463/12, 13

(56) References Cited

U.S. PATENT DOCUMENTS

| | | | | |
|---|---|---|---|---|
| 5,154,429 A | | 10/1992 | LeVasseur | |
| 5,288,077 A | | 2/1994 | Jones | |
| 5,308,081 A | | 5/1994 | Bartle | |
| 5,320,356 A | | 6/1994 | Cauda | |
| 5,322,295 A | | 6/1994 | Cabot et al. | |
| 5,328,189 A | | 7/1994 | Malek | |
| 5,350,175 A | | 9/1994 | DiLullo et al. | |
| 5,407,209 A | | 4/1995 | Prerost | |
| 5,454,570 A | * | 10/1995 | Karal | 273/292 |
| 5,487,547 A | | 1/1996 | Hobert | |
| 5,490,670 A | | 2/1996 | Hobert | |
| 5,566,946 A | | 10/1996 | Parker | |
| 5,573,248 A | | 11/1996 | Parra et al. | |
| 5,632,485 A | | 5/1997 | Woodland et al. | |
| 5,636,842 A | | 6/1997 | Cabot et al. | |
| 5,636,843 A | | 6/1997 | Roberts | |
| 5,660,392 A | | 8/1997 | Hansen | |
| 5,673,917 A | | 10/1997 | Vancura | |
| 5,743,532 A | | 4/1998 | Lafferty | |
| 5,769,422 A | * | 6/1998 | Stromer | 273/274 |
| 5,791,989 A | | 8/1998 | Slinkman | |
| 5,934,675 A | * | 8/1999 | Handelman et al. | 273/292 |
| 5,979,897 A | | 11/1999 | Grossman | |
| 6,000,699 A | * | 12/1999 | Long | 273/292 |
| 6,113,102 A | * | 9/2000 | Marks et al. | 273/292 |
| 6,158,741 A | * | 12/2000 | Koelling | 273/292 |

* cited by examiner

*Primary Examiner*—Jessica Harrison
*Assistant Examiner*—Alex F. R. P. Rada, II
(74) *Attorney, Agent, or Firm*—Salter & Michaelson

(57) ABSTRACT

A new type of side bet or wager which can be made during the game of blackjack or twenty-one is disclosed. The side bet is a secondary bet, which may be placed in addition to the initial (or traditional) bet or ante, and which is preferably made prior to any cards being dealt during the hand. The initial bet is played in the usual manner prior to the dealing of the cards, and at the same time the player decides whether or not to place an additional, or secondary side bet. The player then proceeds to play a conventional game of blackjack, attempting to beat the dealer's hand without busting. The secondary bet only becomes active when the player does not bust, the dealer's hand has a combined point value of less than 21, and the player's hand has a combined point value which is less than that of the dealer's hand.

24 Claims, 1 Drawing Sheet

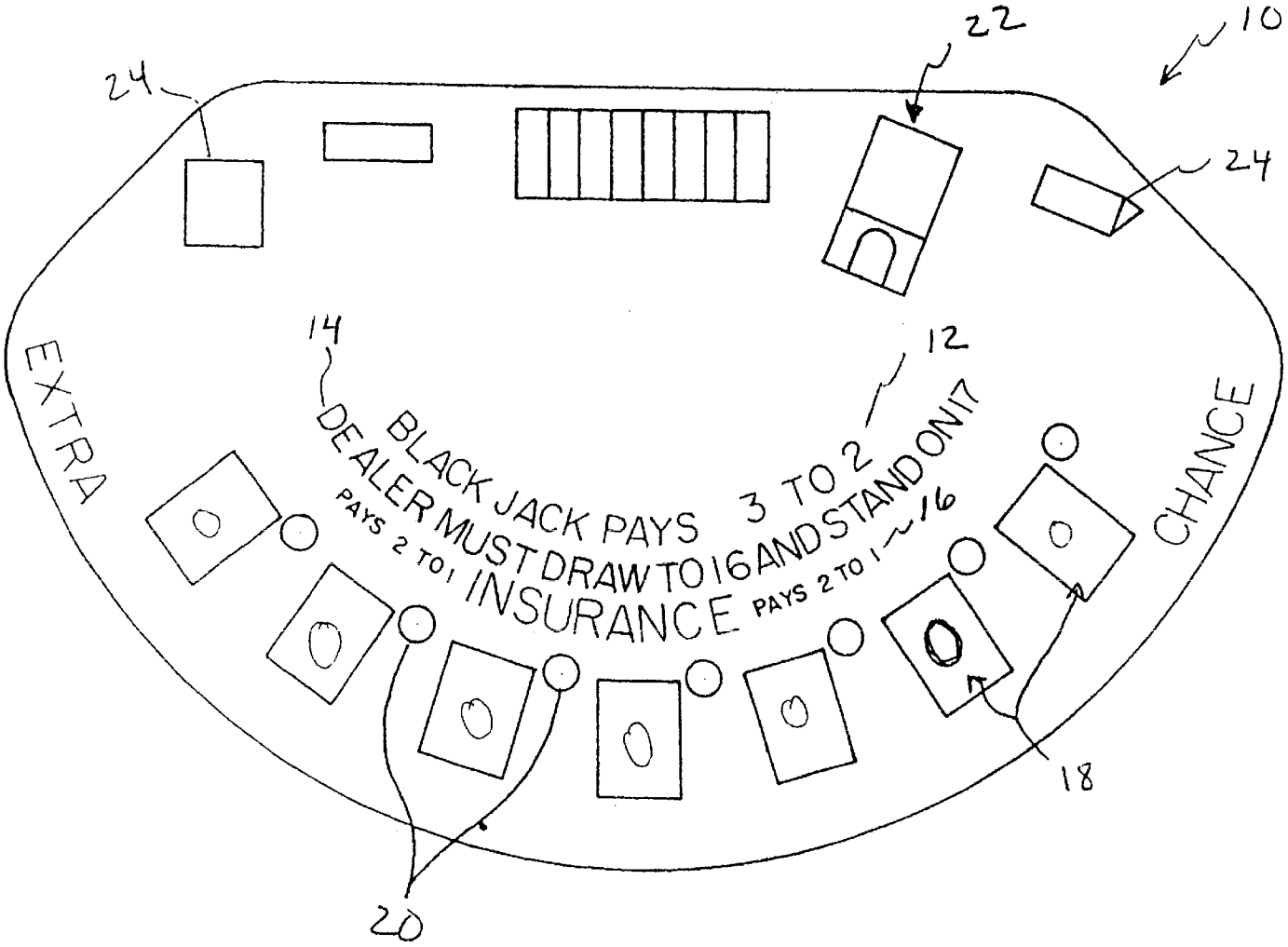
10
24
22
CHANCE
18
16
12
3 TO 2
STAND ONIT
PAYS 2 TO 1
BLACK JACK PAYS
DEALER MUST DRAW TO 16 AND
PAYS 2 TO 1
INSURANCE
14
20
24
EXTRA

METHOD OF MAKING A SIDE BET DURING A BLACKJACK GAME

DESCRIPTION

1. Technical Field

The invention relates generally to betting-type games, and more particularly to a secondary side bet that may be made during a game of blackjack or twenty-one.

2. Background of Related Art

The game of "blackjack", also known as "twenty-one" or "21", has gained popularity in casinos and other types of gaming establishments in recent years. This popularity is due, in part, to the fact that the game is relatively simple to learn and play, and can be played either as a "live" table game, or in electronic, or video form. The objective of the game is for the player to accumulate cards with a combined point value higher than that of the dealer, but not greater than 21.

To begin play, each player places their ante, or initial wager or bet, before any cards are dealt. The ante is typically any amount, at the player's discretion, between minimum and maximum limits set by the house rules of the gaming establishment. Cards are dealt from standard decks of 52 playing cards with each card's point value being its face value, with the exception of face cards (kings, queens and jacks) which have a point value of 10, and Aces which have a point value or either 1 or 11, as determined by the hand of the player. The player initially receives two cards either face-up or face-down. The dealer also receives two cards, usually one face-up and one face-down.

After being dealt the initial two cards, the player may "stand" (take no additional cards), or take a "hit" (be dealt an additional card). The player may continue taking "hits" until she decides to "stand" or until the player "busts" (i.e. the total card point value of the player's cards exceeds 21) in which case the player loses the bet. After all players have taken additional cards and have either bust, or stood on their hand, the dealer then "stands" or "hits" based on pre-established rules of the game. Under most rules, if the dealer has a total card point value of 17 or more, the dealer must stand. However, if the dealer has a total card point value of less than 17, the dealer must take hits until the value is 17 or more, or until the dealer busts. Under conventional rules, if the dealer busts, or if the player has a higher total in her hand than the dealer, without going over 21, then the player is paid 1-to-1 (also referred to as "2-for-1") based on the initial or primary bet. If the player and the dealer have the same total point value in their hands, it is a draw or "push", and the player breaks even (i.e., the player does not win or lose the bet). If the dealer has a total of 21 in the first two cards (i.e. blackjack), the house wins and the player loses his or her bet, unless the player also has blackjack (first two cards total 21), in which case there is also usually a push.

The lack of complexity in playing blackjack, and the relatively low payouts often causes players to become bored with the game and to lose interest. Therefore, in a conventional game there are additionally three well known alternative betting procedures which add to the game's interest. These are "insurance", "doubling down" and "splitting pairs".

After each player and the dealer receives their first two cards, if the dealer's face-up card is an Ace, each player may elect to make an "insurance" bet. The amount of the insurance bet, for each player making the election, is usually a maximum of one-half of the amount of the player's initial bet. If the dealer has blackjack (a two card, 21 point hand), each player placing an insurance bet wins and is paid on a 2 to 1 basis for the insurance bet only. All players who do not also have a two card, 21 point hand (a blackjack), lose their initial bet regardless of their insurance bet. If the dealer does not have blackjack, all insurance bets are forfeited and play continues as described above.

Another well known procedure permitted by gaming establishments is "doubling down". The initial two card point total which permits a player to elect to "double down", is established by house rules. Although many casinos now allow the player to double down on any initial two card hand, the three most common double down hand point values utilized by gaming establishments are (a) 9, 10 or 11; (b) 10 or 11; or (c) 11 only. If the player has an initial two card hand point total equal to one of the values established by the house rules, the player may elect to double down. The player informs the dealer of the election to double down and places an additional bet equal to or less than the amount of the initial bet. The dealer then deals to that player one and only one additional card, and the resulting three card hand establishes the final point value for that player's hand. The player's three card hand point value is compared with the dealer's final hand point value, and the amount of the player's bet is the total of the initial bet and the double down bet.

Another well known procedure permitted by gaming establishments is "splitting pairs". If the first two cards of a player's hand are a pair or are both 10 point cards, that player may elect to "split" the initial two cards into two separate hands. The player then elects to apply the initial bet to one of the two hands and places an equal additional bet for the other hand. Both of the original two cards are then turned face up and the player plays each of the two hands as a separate hand in accordance with the house rules. Some gaming establishments only allow splitting if the player's first two cards are a true pair, and may further limit the number of pairs which may be split. House rules may allow a player to double down on either or both hands.

Although these additional bets do add some excitement to the game, the complexity and payouts still allow more seasoned players to become bored and lose interest with the game. In addition, the game is not the most profitable to the gaming establishment since the house advantage or edge in blackjack is extremely small against players who do nothing more than play what is conventionally referred to as "basic strategy", a system of play which defines the best action (hit, stand, double-down, etc.) the player should take in each playing situation. Also, since the betting action is limited, the profitability intake for the gaming establishment over a period of time is smaller than it would be if additional betting action were available.

There have been a number of modifications proposed to the game of blackjack which allow the player the opportunity to make additional wagers. However, these additional betting arrangements are often complex and not easy for novice players to understand. In addition, such bets may significantly favor the gaming establishment which may deter players from placing such bets.

Accordingly, it is an object of the present invention to provide a secondary bet or side bet which is easy to understand and play, which increases the opportunity for the player to win in a situation where they have lost their initial bet, and which has the potential to increase the wagering during the hand.

SUMMARY

In accordance with the present method, there is provided a new type of side bet or wager which can be made during the game of blackjack or twenty-one (hereinafter referred to simply as blackjack). The side bet is a secondary bet, which may be placed in addition to the initial (or traditional) bet or ante, and which may be made prior to any cards being dealt during the hand. Specifically, the primary or initial bet is played in the usual manner prior to the dealing of the cards, and at the same time the player decides whether or not to place an additional, or secondary side bet. The player then proceeds to play a conventional game of blackjack, attempting to beat the dealer's hand without busting (going over a combined card point value of 21). The secondary bet only becomes active when the player does not bust, the dealer's hand has a combined point value of less than 21 (and preferably greater than 16), and the player's hand has a combined point value which is less than that of the dealer's hand (and preferably greater than 12). Under a conventional game of blackjack, if these criteria are met the player would lose the initial bet and no further chance of winning would be afforded. However, according to the present method, if the player has placed the secondary bet, the player's secondary bet becomes activated at this point in the game. The player is then given a single additional card in an attempt to beat the total point value of the dealer's hand without going over a total point value of 21. If the player beats the total point value of the dealer's hand when receiving the additional card without busting, the house must pay increased odds to the player. In one embodiment the odds are as follows:

| | Dealer Total | Payout |
|---|---|---|
| If the player beats | 17 | 2:1 |
| If the player beats | 18 | 3:1 |
| If the player beats | 19 | 5:1 |
| If the player beats | 20 | 11:1 |

If the player does not beat the combined or total point value of the dealer's hand upon receiving the additional card on the secondary bet, or if the player busts when receiving the additional card, then the secondary bet is forfeited or lost. In addition, if after playing the conventional blackjack hand the player busts, or if the dealer and/or the player have blackjack, the secondary bet is not activated, but is instead returned to the player. In another embodiment, if the player splits his or her pair, then the secondary bet will only be activated on the first split hand. If the player doubles down, then he or she will receive one additional card and the second chance bet will be subject to the same activation rules described herein above.

BRIEF DESCRIPTION OF THE DRAWING

It should be understood that the drawing is provided for the purpose of illustration only and is not intended to define the limits of the invention. The foregoing and other objects and advantages of the embodiments described herein will become apparent with reference to the following detailed description when taken in conjunction with the accompanying drawing in which:

FIG. 1 is a top plan view showing a layout of a table top, game board and electronic display which may be used when playing the game of blackjack, including when making a secondary side bet according to the present invention.

DETAILED DESCRIPTION OF THE ILLUSTRATIVE EMBODIMENTS

The terms standard or conventional method, standard or conventional manner, and standard or conventional rules as used herein are intended to refer to a conventional game of blackjack or twenty-one as previously described in the background, as well as any known variations of the game blackjack or twenty-one. Likewise, the terms "stand", "hit", "bust", "push", "hand", "bet" and "blackjack" are used in their conventional manner as known to those of skill in the art.

A tabletop 10 for playing a game of blackjack including indicia printed thereon is illustrated in FIG. 1. Indicia 12, 14, and 16, may describe the basic rules of blackjack, for example, "blackjack pays 3 to 2, " "Dealer must draw to 16 and stand on 17," and "Insurance pays 2 to 1," as is conventional. In addition, indicia 18 may also be provided at the table top for designating where the cards of each player are to be dealt and where the primary bet is made, and indicia 20 may be provided for indicating where each player places his or her secondary bet. A shoe 22 is also displayed on the tabletop containing the cards used to play blackjack and additional signs 24 may also be provided which can indicate other rules of the house, for example, the minimum bets which may be placed at a certain table and the rules and payout. In order that the present invention may be used with conventional blackjack tables are shown in described in FIG. 1, there is no need for additional indica to show where the secondary bet or wager may be placed. However, such indicia may be provided if desired.

Prior to being dealt any cards, the player places his initial ante or bet within indicia 18. The player may then additionally place a secondary bet on the table, for example, within indicia 20. By placing the initial bet, the player is betting that he or she will achieve a total card point value closer to 21 (twenty-one) than the card point value of the dealer's hand without going over 21. The secondary bet is placed as a type of insurance, should the player lose the initial bet because the dealer's hand has a card point value of less than 21 (i.e. 20 or less), but the dealer's hand nevertheless beats the players hand, assuming the player has not busted. In the preferred embodiment, the secondary bet may only equal one half of the initial bet. However, the house may decide the actual value limits of the secondary bet, as desired. In addition, the house may allow the secondary bet to be placed at any time while playing the hand, other than before the cards are dealt.

The dealer then proceeds with passing out cards as in a conventional game of blackjack. Specifically, the dealer may deal one card to each player, one card to the dealer, one more card to each player, and one more card to the dealer. Each player and the dealer thereby initially have two cards each. Typically, the cards of the player are face up, whereas only one of the dealer's cards is revealed (i.e., face up) and the second card is placed face down. As described herein above, the player may choose to "stand" (i.e., receive no additional cards) or take a "hit" (i.e., be dealt an additional card). The player's decision to either stand or hit is based upon whether or not the player believes he or she has a total combined point value greater than the anticipated total point value of the dealer's hand. The player may continue taking hits until he or she decides to stand, or until the player "busts" (i.e., the combined card point value of the hand is higher than 21).

Once all of the players stand or have busted, the dealer may stand or draw additional cards, generally based on predetermined house rules. Conventionally, if the dealer has less than a combined point value of 17, the dealer must draw an additional card. However, if the dealer has a combined point value of 17 or more, the dealer must stand. The closest of each of the players and dealer to a total card point value of 21 without going over wins. Thus, any player having a hand with a combined point value higher than the dealer and who does not exceed 21 wins. However, in a conventional game of blackjack if the player's card point value is less than the dealer's point value, the player loses. Ties between the players and the dealers are "pushed" (i.e., the bet is neither lost or won but is returned to the player).

The secondary bet according to the present embodiment becomes activated upon the player not busting, the dealer's hand having a combined point value of less than 21 (and preferably greater than 16), and the player's hand having a combined point value less than the dealer's total (and preferably equal to or greater than 12). Under conventional rules of play, the player loses the initial bet and no further opportunity to win is afforded the player. However, under the present method, if all three of the above criteria are met, and if the player has placed a secondary bet at the beginning of the game prior to dealing the cards for the subject hand, then the secondary bet becomes activated at this point in the game. Upon activation of the secondary bet, the player is automatically dealt one additional card in an attempt to beat the combined point value of the dealer's hand without busting. If the additional card dealt makes the combined point value of the player's hand higher than the dealer's hand without the player going over 21, then the house pays increased odds to the player. In a preferred embodiment the house pays the following odds.

| | Dealer Total | Payout |
|---|---|---|
| If the player beats | 17 | 2:1 |
| If the player beats | 18 | 3:1 |
| If the player beats | 19 | 5:1 |
| If the player beats | 20 | 11:1 |

If during the initial hand the player has busted, the dealer has 21, or the player has won the initial bet, the secondary bet is simply returned to the player and is never activated. The secondary side bet allows the player to win the side bet in a situation where the player would have lost their initial bet and would have no further opportunity for winning. The secondary bet is easy to understand and play and allows for increased wagering during the hand. The secondary bet is also attractive to the gaming establishment since it may encourage players to forgo "basic strategy" and to stand on hands where he or she should take a card in a hope of winning the secondary side bet.

The present method of placing the secondary bet may be used in conjunction with other traditional methods of playing blackjack as described hereinabove. For example, a traditional "insurance" bet may still be placed by the player. The secondary bet may also be used with the doubling down procedure and when splitting pairs (also known as splitting hands). When splitting pairs, however, the secondary bet may preferably be activated only on the player's first hand.

The criteria for activating the secondary bet may be modified, as would be known to one of skill in the art. For example, the house may decide that the secondary bet may be activated only if the combined point value of the dealer's hand is less than 20, or if the player's hand is equal to or less than the dealer's hand. In addition, the payout odds may be varied, and the secondary side bet described herein may also be played with modified forms of blackjack which allow for varying methods of play and additional bets other than conventional bets. The present method of making a secondary bet may also be played on a table with a live dealer, or alternately be played when any other known form of blackjack is played, for example, in an electronic video game machine or using the internet, as would be known to one of skill in the art.

Therefore, it will be understood that various modifications may be made to the embodiment disclosed herein. For example, the value of the secondary bet which the house allows may be altered, as would be known to one of skill in the art, and the payout odds may also be altered as the payouts provided by the applicant are contemplated as a preferred embodiment only. The above description should not be construed as limiting, but merely as exemplifications of a preferred embodiment. Those skilled in the art will envision other modifications within the scope, spirit and intent of the invention.

What is claimed is:

1. In a method of playing a conventional hand of blackjack wherein a player places an initial bet and attempts to accumulate cards with a total numerical point value higher than a total numerical point value of a dealer's cards, but not greater than twenty-one, the improvement comprising:

a.) allowing the player to place a secondary bet in addition to the initial bet;

b.) activating the secondary bet when the total numerical point value of the dealer's cards is less than twenty-one, and the total numerical point value of the player's cards is both less than twenty-one and less than the total numerical point value of the dealer's cards;

c.) upon activation of the secondary bet, dealing a single additional card to the player in an attempt to exceed the total numerical point value of the dealer's cards without exceeding a total numerical point value of twenty-one.

2. The improvement of claim 1, further comprising the step of returning the secondary bet to the player if the total numerical point value of the player's cards exceeds twenty-one prior to activation of the secondary bet.

3. The improvement of claim 1, further comprising the step of returning the secondary bet to the player if the total numerical point value of the dealer's cards is twenty-one or higher prior to activation of the secondary bet.

4. The improvement of claim 1, further comprising the step of returning the secondary bet to the player if the total numerical point value of the player's cards prior to dealing the second additional card is equal to or less than twenty-one and higher than the total numerical point value of the dealer's cards prior to activation of the secondary bet.

5. The improvement of claim 1, wherein upon the player receiving an additional card after activation of the secondary bet, if the total numerical point value of the player's cards exceeds the total numerical point value of the dealer's cards without exceeding a total numerical point value of twenty-one, the player being paid increased odds on the secondary bet.

6. The improvement of claim 5, wherein if the total numerical point value of the player's cards exceeds a total numerical point value of seventeen for the dealer's cards, the player receives a two to one payout on the secondary bet.

7. The improvement of claim 5, wherein if the total numerical point value of the player's cards exceeds a total numerical point value of eighteen for the dealer's cards, the player receives a three to one payout on the secondary bet.

8. The method of claim 5, wherein if the total numerical point value of the player's cards exceeds a total numerical point value of nineteen for the dealer's cards, the player receives a five to one payout on the secondary bet.

9. The method of claim 5, wherein if the total numerical point value of the player's cards exceeds a total numerical point value of twenty for the dealer's cards, the player receives an eleven to one payout on the secondary bet.

10. The improvement of claim 1, wherein the secondary bet is activated when the total numerical point value of the dealer's cards is greater than sixteen and less than twenty-one, and the total numerical point value of the player's cards is both less than 21 and less than the total numerical point value of the dealer's cards.

11. The improvement of claim 1, wherein the secondary bet is placed in combination with a player splitting a matched pair of cards so that the player has a first hand of cards and a second hand of cards with which to play, wherein the secondary bet is activated only on the first hand of cards.

12. The improvement of claim 1, wherein the secondary bet has a value no greater than the initial bet.

13. The improvement of claim 12, wherein the secondary bet has a value equal to one half of the primary bet.

14. The improvement of claim 1, wherein the secondary bet is placed prior to any cards being dealt in the hand.

15. A method of playing blackjack comprising the steps of:

a.) a player making an initial bet and a secondary bet;

b.) a dealer initially dealing two cards to the player and two cards to the dealer;

c.) allowing the player to take additional cards, as desired;

d.) allowing the dealer to take additional cards according to pre-established rules of play;

e.) adding a numerical point value assigned to each of the cards in order to determine the total numerical point value of both the dealer's cards and the player's cards;

f.) the player losing the initial bet if the total numerical point value of the player's cards exceeds a value of twenty-one;

g.) comparing the total numerical point value of the player's cards to the total numerical point value of the dealer's cards;

h.) the player losing the initial bet if the total numerical point value of the player's cards is less than twenty-one and less than the total numerical point value of the dealer's cards, if the total numerical point value of the dealer's cards is twenty-one or less;

g.) activating the secondary bet when the total numerical point value of the dealer's cards is less than twenty-one, and the total numerical point value of the player's cards is both less than twenty-one and less than or equal to the total numerical point value of the dealer's cards;

h.) upon activation of the secondary bet, dealing a single additional card to the player in an attempt to exceed the total numerical point value of the dealer's cards without exceeding a total numerical point value of twenty-one.

16. The method of claim 15, further comprising the step of returning the secondary bet to the player if the total numerical point value of the player's cards exceeds twenty-one prior to activation of the secondary bet.

17. The method of claim 15, further comprising the step of returning the secondary bet to the player if the total numerical point value of the dealer's cards is twenty-one or higher prior to activation of the secondary bet.

18. The method of claim 15, further comprising the step of returning the secondary bet to the player if the total numerical point value of the player's cards prior to dealing the second, additional card is less than twenty-one and higher than the total numerical point value of the dealer's cards prior to activation of the secondary bet.

19. The method of claim 15, further comprising the step of returning the secondary bet to the player if the total numerical point value of the dealer's cards is twenty-one or less and if the total numerical point value of the player's cards is twenty-one or less and equal to the total numerical point value of the dealer's cards.

20. The method of claim 15, wherein upon the player receiving an additional card after activation of the secondary bet, if the total numerical point value of the player's cards exceeds the total numerical point value of the dealer's cards without exceeding a total numerical point value of twenty-one, the player being paid increased odds on the secondary bet.

21. The method of claim 15, wherein the secondary bet is activated when the total numerical point value of the dealer's cards is greater than sixteen and less than twenty-one, and the total numerical point value of the player's cards is both less than twenty-one and less than the total numerical point value of the dealer's cards.

22. The method of claim 15, wherein the secondary bet has a value no greater than the initial bet.

23. The method of claim 22, wherein the secondary bet has a value equal to one-half of the primary bet.

24. The method of claim 15, wherein the secondary bet is placed at any time during a hand.

* * * * *